US007705815B2

(12) United States Patent
Yun et al.

(10) Patent No.: US 7,705,815 B2
(45) Date of Patent: Apr. 27, 2010

(54) BACKLIGHT CONTROL UNIT AND LIQUID CRYSTAL DISPLAY DEVICE HAVING THE SAME

(75) Inventors: Jae-Kyeong Yun, Seoul (KR); Hyun-ho Shin, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 900 days.

(21) Appl. No.: 11/476,118

(22) Filed: Jun. 28, 2006

(65) Prior Publication Data

US 2006/0290648 A1 Dec. 28, 2006

(30) Foreign Application Priority Data

Jun. 28, 2005 (KR) ..... 10-2005-0056586

(51) Int. Cl.
*G09G 3/36* (2006.01)

(52) U.S. Cl. ..... 345/89; 345/82; 345/99; 345/102

(58) Field of Classification Search ..... 345/82, 345/89, 99, 102
See application file for complete search history.

(56) References Cited

U.S. PATENT DOCUMENTS

2001/0033260 A1 10/2001 Nishitani et al.
2002/0122020 A1* 9/2002 Moon et al. ..... 345/89
2002/0130830 A1 9/2002 Park
2005/0001801 A1* 1/2005 Kim ..... 345/89

FOREIGN PATENT DOCUMENTS

DE 10 2004 030 556 A1 7/2005
EP 1 569 195 A1 8/2005

* cited by examiner

*Primary Examiner*—Amare Mengistu
*Assistant Examiner*—Joseph G Rodriguez
(74) *Attorney, Agent, or Firm*—Holland & Knight LLP

(57) ABSTRACT

A backlight control unit for a liquid crystal display device includes a liquid crystal panel for displaying an image, a backlight for providing light to the liquid crystal panel, a gate driving unit and a data driving unit for driving the liquid crystal panel, a timing controller for outputting signals to control the gate driving unit and the data driving unit, and for outputting a dimming control signal to control a light output amount of the backlight according to representative gradation values obtained by analyzing red, green, and blue gradations included in inputted image data, and an inverter for controlling the backlight to control a light output amount from the backlight according to the dimming control signal outputted from the timing controller.

14 Claims, 2 Drawing Sheets

RELATE ART

RELATE ART

BACKLIGHT CONTROL UNIT AND LIQUID CRYSTAL DISPLAY DEVICE HAVING THE SAME

The present invention claims the benefit of Korean Patent Application No. P2005-0056586 filed in Korea on Jun. 28, 2005, which is hereby incorporated by reference in its entirety.

BACKGROUND OF THE INVENTION

1. Field of the Invention

The present invention relates to a display device, and more particularly, to a backlight control unit and a liquid crystal display (LCD) device having the same. Although the present invention is suitable for a wide scope of applications, it is particularly suitable for controlling an optical output of a backlight according to an image.

2. Description of the Background Art

Generally, an LCD device includes a liquid crystal panel with a plurality of pixels arranged in a matrix form, and a driving unit for driving the pixels. The liquid crystal panel includes a color filter substrate, a thin film transistor (TFT) array substrate attached to the color filter substrate, and a liquid crystal layer interposed therebetween. A common electrode and a pixel electrode are formed on the color filter substrate and the TFT array substrate, respectively, through which an electric field is applied across the liquid crystal layer.

FIG. 1 is a plan view showing red, green and blue pixels arranged on a liquid crystal panel in accordance with the related art. The red (R), green (G), and blue (B) pixels sequentially arranged on a substrate 110 in a matrix form, as shown in FIG. 1. Since the LCD device is not a light emitting device but rather an optical modulation device, a backlight is provided at a rear surface of the substrate 110. The amount of light emitted from the backlight transmitted through the R, G, and B pixels is controlled, to thereby display a desired image. More specifically, the R, G, and B pixels of the LCD device transmit R, G, and B wavelengths of light emitted from the backlight and absorb other wavelengths, respectively. Thus, the LCD device has brightness lower than a related art color cathode ray tube. Therefore, an LCD device having four sub pixels for implementing a white pixel (W) in addition to the R, G, and B pixels has been proposed.

FIG. 2 is a plan view showing red, green, blue, and white pixels arranged on a liquid crystal panel in accordance with the related art. The red (R), green (G), blue (B), and white (W) pixels are sequentially arranged on a substrate 210 in a matrix form, as shown in FIG. 2. As aforementioned, the R, G, and B pixels of the LCD device transmit R, G, and B wavelengths of light emitted from the backlight and absorb other wavelengths, respectively. The white pixel (W) increases brightness of a white color component that is also collectively generated by the R, G, and B pixels, thereby enhancing an entire brightness of the LCD device.

Each amount of light that passes through the R, G, and B pixels is determined according to an alignment direction of liquid crystal corresponding to the R, G, and B pixels. The alignment direction of liquid crystal is controlled by R, G, and B gradations constituting image data. The gradation is a value representing brightness of light that passes through each of the respective R, G and B pixels.

A white gradation implemented by the white pixel (W) is determined according to the R, G, and B gradations of the image data. For instance, the white gradation can be determined by applying a minimum value among the R, G, and B gradations or a squared value of the minimum value to the white pixel. However, there is a limitation as to how much the entire brightness of the LCD device can be enhanced by using white (W) pixels.

The limitation is due to the amount of space occupied by the white (W) pixel, which is a ¼ of the entire area among the R, G, and B pixels. Since the white pixel is very narrow, an overall light output amount of white light emitted through the white pixel is not very substantial. According to the conventional algorithm for determining a white gradation, if one or two of R, G, and B gradations is a minimum value, the minimum value is applied as a white gradation. Such an algorithm may result in the entire brightness of an LCD device having R, G, B, and W pixels being lower than that of an LCD device composed of R, G, and B pixels. Further, such an algorithm may result in only primary colors, such as red, green, blue, magenta, yellow, and cyan, being displayed if one or two of the R, G, and B gradations is at a very low value.

SUMMARY OF THE INVENTION

Accordingly, the present invention is directed to a backlight control unit and a liquid crystal display device having the same that substantially obviate one or more of the problems due to limitations and disadvantages of the related art.

An object of the present invention is to provide a backlight control unit for displaying a brighter and clearer image.

Another object of the present invention is to minimize power consumption.

To achieve these and other advantages and in accordance with the purpose of the present invention, as embodied and broadly described herein, there is provided a liquid crystal display (LCD) including a liquid crystal panel for displaying an image, a backlight for providing light to the liquid crystal panel, a gate driving unit and a data driving unit for driving the liquid crystal panel, a timing controller for outputting signals to control the gate driving unit and the data driving unit, and for outputting a dimming control signal to control a light output amount of the backlight according to representative gradation values obtained by analyzing red, green, and blue gradations included in inputted image data, and an inverter for controlling the backlight to control a light output amount from the backlight according to the dimming control signal outputted from the timing controller.

According to another aspect of the present invention, there is provided a liquid crystal display device including a liquid crystal panel and a backlight control unit for controlling a light output amount transmitted to the liquid crystal panel, in which the backlight control unit includes a gate driving unit and a data driving unit for driving the liquid crystal panel, a timing controller for outputting signals to control the gate driving unit and the data driving unit, and outputting a dimming control signal to control a light output amount of the backlight according to representative gradation values obtained by analyzing red, green, and blue gradations in inputted image data, and an inverter for controlling the backlight to output a corresponding light output amount from the backlight according to the dimming control signal outputted from the timing controller.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Hereinafter, a liquid crystal display (LCD) device according to the present invention will be explained with reference to the attached drawings.

Figure 1:
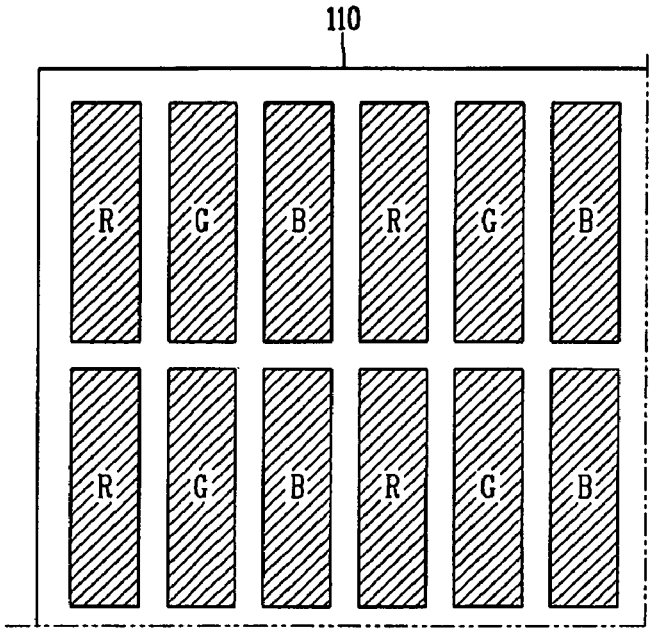
FIG. 1 is a plan view showing red, green and blue pixels arranged on a liquid crystal panel in accordance with the related art.
Figure 2:
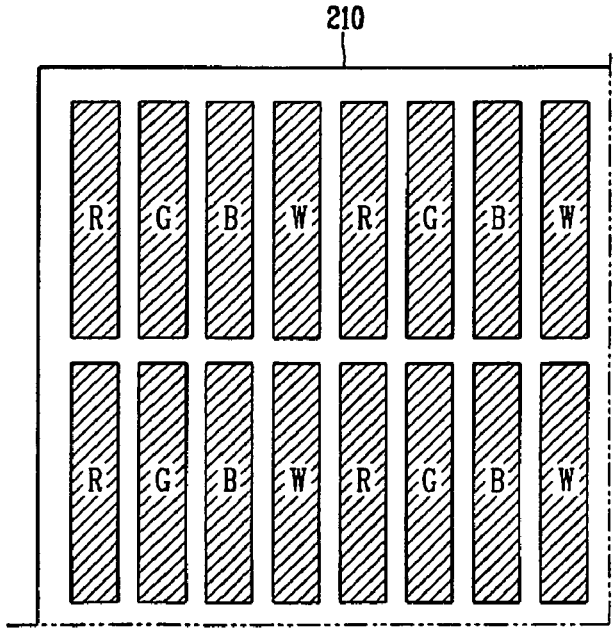
FIG. 2 is a plan view showing red, green, blue, and white pixels arranged on a liquid crystal panel in accordance with the related art.
Figure 3:
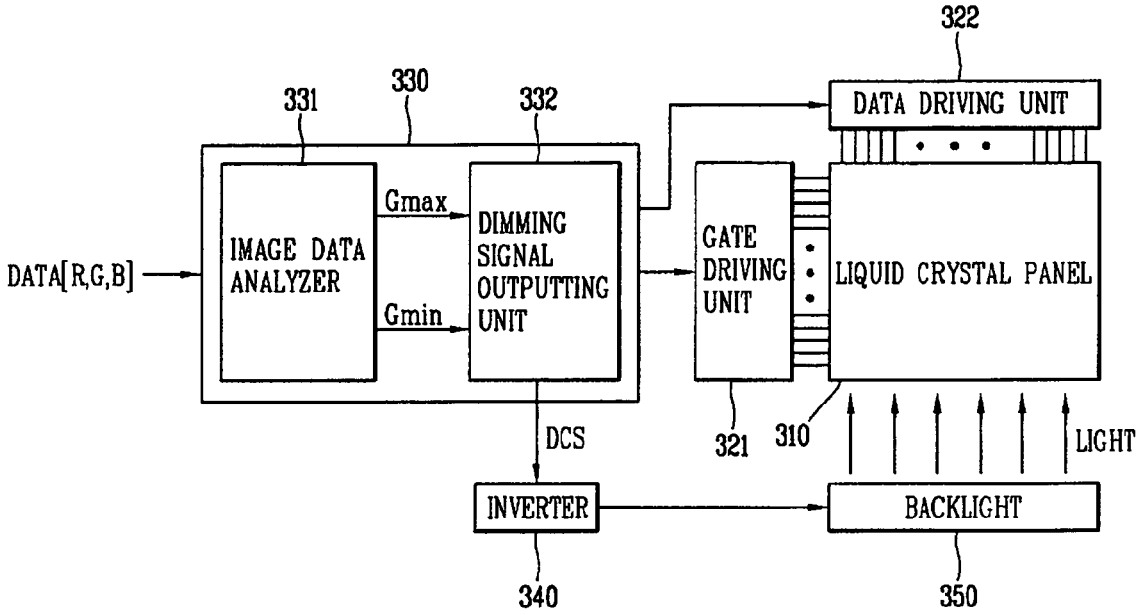
FIG. 3 is a block diagram showing a liquid crystal display device according to an embodiment of the present invention.

FIG. 3 is a block diagram showing a liquid crystal display device according to an embodiment of the present invention. As shown in FIG. 3, the LCD device includes a liquid crystal panel 310 for displaying an image, a backlight 350 for providing light to the liquid crystal panel 310, a gate driving unit 321 and a data driving unit 322 for driving the liquid crystal panel 310, a timing controller 330 for obtaining each representative gradation value by analyzing R, G, and B gradations of image data provided from the outside and outputting a dimming control signal (DCS) to control a light output amount from the backlight according to two representative gradation values among the three representative gradation values, and an inverter 340 for controlling the backlight 350 according to the dimming control signal (DCS) and thereby outputting a corresponding a light output amount from the backlight. More specifically, the timing controller 330 includes an image data analyzer 331 for calculating each representative gradation value by analyzing R, G, and B gradations of image data inputted from outside and outputting two representative gradation values among the three representative gradation values, and a dimming signal outputting unit 332 for outputting a dimming control signal (DCS) corresponding to a backlight duty ratio (%) determined according to the representative gradation values provided from the image data analyzer 331 to the inverter 340. In the alternative, the image data analyzer 331 and the dimming signal outputting unit 332 can be positioned outside of the timing controller 330.

Image data (R, G, and B) is consecutively inputted to the image data analyzer 331 as a frame unit. The image data analyzer 331 analyzes R, G, and B gradations included in the image data of one frame unit and then outputs a representative gradation value for each of the R, G, and B gradations. For instance, the image data analyzer 331 calculates an average gradation value from red gradations corresponding to each red pixel included in the image data (R, G, and B) of one frame, thereby outputting it as a representative gradation value of the red gradation. Likewise, the image data analyzer 331 outputs each representative gradation value for a green gradation and a blue gradation.

The image data analyzer 331 calculates each representative gradation value for a red gradation, a green gradation, and a blue gradation by analyzing image data (R, G, and B) of one frame, and then provides two representative gradation values among the three representative gradation values to the dimming signal outputting unit 332. The two representative gradation values provided to the dimming signal outputting unit 332 are a maximum gradation value (Gmax) and a minimum gradation value (Gmin) among the three representative gradation values for R, G, and B.

The dimming signal outputting unit 332 outputs a dimming control signal (DCS) to control a backlight duty ratio corresponding to the maximum gradation value (Gmax) and the minimum gradation value (Gmin). The dimming signal outputting unit 332 is provided with an algorithm for determining a backlight duty ratio by applying the maximum gradation value (Gmax) and the minimum gradation value (Gmin) therein. More specifically, the dimming signal outputting unit 332 applies different methods for determining backlight duty ratios according to each difference between the maximum gradation value (Gmax) and the minimum gradation value (Gmin).

The inverter 340 sets a backlight duty ratio according to the dimming control signal (DCS) provided from the dimming signal outputting unit 332. A current amount supplied to the backlight 350 per unit hour increases in correspondence with the set backlight duty ratio. Therefore, as the set backlight duty ratio increases, the light output from the backlight 350 increases.

The dimming signal outputting unit 332 determines a backlight duty ratio (%) by applying the following formulas according to a range of a difference between the maximum gradation value (Gmax) and the minimum gradation value (Gmin).

$$\text{Backlight duty ratio}(\%) = \left(\frac{\frac{Gmax + Gmin}{2}}{255} * 0.5 + 0.5\right) * 100 \quad \text{[Formula 1]}$$

The formula 1 is applied when the difference between the maximum gradation value (Gmax) and the minimum gradation value (Gmin) is less than 15 gradations, in which a weight value is 0.5.

$$\text{Backlight duty ratio}(\%) = \left(\frac{\frac{Gmax + Gmin}{2}}{255} * 0.4 + 0.5\right) * 100 \quad \text{[Formula 2]}$$

The formula 2 is applied when the difference between the maximum gradation value (Gmax) and the minimum gradation value (Gmin) is in a range of 16~64, in which a weight value is 0.4.

$$\text{Backlight duty ratio}(\%) = \left(\frac{\frac{Gmax + Gmin}{2}}{255} * 0.3 + 0.5\right) * 100 \quad \text{[Formula 3]}$$

The formula 3 is applied when the difference between the maximum gradation value (Gmax) and the minimum gradation value (Gmin) is in a range of 64~128, in which a weight value is 0.3.

$$\text{Backlight duty ratio}(\%) = \left(\frac{\frac{Gmax + Gmin}{2}}{255} * 0.4 + 0.5\right) * 100 \quad \text{[Formula 4]}$$

The formula 4 is applied when the difference between the maximum gradation value (Gmax) and the minimum gradation value (Gmin) is in a range of 128~191, in which a weight value is 0.4.

$$\text{Backlight duty ratio}(\%) = \left(\frac{\frac{Gmax + Gmin}{2}}{255} * 0.5 + 0.5\right) * 100 \quad \text{[Formula 5]}$$

The formula 5 is applied when the difference between the maximum gradation value (Gmax) and the minimum gradation value (Gmin) is more than 191, in which a weight value is 0.5.

The formulas 1 to 5 are algorithms used in the dimming signal outputting unit 332 for determining each backlight duty ratio according to each difference between the maximum gradation value (Gmax) and the minimum gradation value (Gmin). The dimming signal outputting unit 332 determines each backlight duty ratio by applying one of the formulas 1 to 5 to which each weight value corresponding to 0.3~0.5 is applied according to each difference between the maximum gradation value (Gmax) and the minimum gradation value (Gmin). However, the application range can be more extended and more minutely control the brightness of the backlight.

Backlight duty ratios are determined by applying different weight values to the corresponding formulas according to each difference between the maximum gradation value (Gmax) and the minimum gradation value (Gmin). For instance, when a difference between the maximum gradation value (Gmax) and the minimum gradation value (Gmin) is less than 15 gradations, the maximum gradation value (Gmax) and the minimum gradation value (Gmin) have similar gradation values and thus an image having a color almost closer to an achromatic color is displayed on a liquid crystal panel.

The more that a red gradation value, a green gradation value, and a blue gradation value are similar to one another, the closer an image is to an achromatic color (gray) a color. In this case, brightness of the image is lower than that of a general color (a middle gradation). Therefore, the dimming signal outputting unit 332 determines a duty ratio of the backlight 350 to be comparatively high by applying a greatest value, 0.5 in the range of 0.3~0.5, thereby increasing a light output amount of the backlight 350, enhancing a brightness of the image, and thus displaying a brighter and clearer image.

If the difference between the maximum gradation value (Gmax) and the minimum gradation value (Gmin) is more than 191 gradation, an image displayed on the liquid crystal panel 310 has a color closer to a primary color. For instance, in a normally black mode LCD device to which 256 gradations are applied, a minimum gradation representing the darkest black is 0 gradation, and a maximum gradation representing the brightest white is 255 gradation. If a red gradation, a green gradation, and a blue gradation are respectively 255, 200, and 5, the image has a primary color resulting from that red and green mixed with each other. In this case, brightness of the image is lower than that of a general color (a middle gradation). Therefore, the dimming signal outputting unit 332 determines a duty ratio of the backlight 350 to be comparatively high by applying a greatest value, 0.5 in the range of 0.3~0.5, thereby increasing a light output amount of the backlight 350, enhancing a brightness of the image, and thus displaying a brighter and clearer image. The dimming signal outputting unit 332 determines each backlight duty ratio with regard to each color that belongs to a region between the achromatic color region and the primary color region by applying one of the formulas 2 to 4

Figure 4:
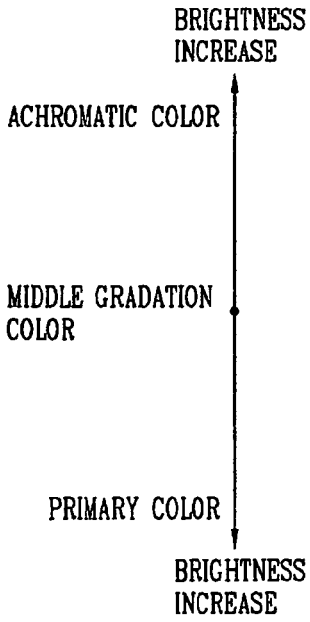
FIG. 4 is a scale showing brightness variation of a backlight according to a color of an image in the LCD device according to an embodiment of the present invention.

FIG. 4 is a scale showing brightness variation of a backlight according to a color of an image in the LCD device according to an embodiment of the present invention. When a color of an image displayed on the liquid crystal panel 310 is closer to an achromatic color or a primary color, a duty ratio of the backlight 350 is increased by the dimming signal outputting unit 332 and thus a light output of the backlight 350 is increased. Consequently, when a color of an image displayed on the liquid crystal panel 310 is closer to an achromatic color or a primary color, a brightness of the image is increased and displayed more brightly.

As aforementioned, in the LCD device in embodiments of the present invention, different backlight duty ratios are set according to each representative gradation value calculated by analyzing R, G, and B gradations of image data. Therefore, if an image displayed on the liquid crystal panel has a color closer to a primary color or an achromatic color, a light output amount of the backlight is increased to enhance a picture quality. Further, since image data is analyzed and an light output the backlight is controlled by the analyzed result, power consumption is reduced.

It will be apparent to those skilled in the art that various modifications and variations can be made in the backlight control unit and the liquid crystal display device having the same of the present invention without departing from the spirit or scope of the invention. Thus, it is intended that the present invention cover the modifications and variations of this invention provided they come within the scope of the appended claims and their equivalents.

What is claimed is:

1. A backlight control unit for a liquid crystal display device, comprising:

a liquid crystal panel for displaying an image;

a backlight for providing light to the liquid crystal panel;

a gate driving unit and a data driving unit for driving the liquid crystal panel;

a timing controller for outputting signals to control the gate driving unit and the data driving unit, the timing controller including, an image data analyzer for calculating each representative gradation value by analyzing red, green, and blue gradations of the image data of one frame unit, and outputting two representative gradation values among three representative gradation values as maximum gradation value and minimum gradation value; and a dimming signal outputting unit for outputting a dimming control signal to control the light output amount of the backlight according to the maximum gradation value and minimum gradation value provided from the image data analyze; and an inverter for controlling the backlight to control a light output amount from the backlight according to the dimming control signal outputted from the timing controller, wherein the backlight duty ratio is determined by a difference between the maximum gradation value and the minimum gradation value.

2. The backlight control unit of claim 1, wherein the representative gradation values are average gradation values of the red, green, and blue gradations.

3. The backlight control unit of claim 1, wherein when the difference between the first data and the second data is less than 15 gradations, the backlight duty ratio is determined by a following formula, $$\text{Backlight duty}(\%) = \left(\frac{\frac{Gmax + Gmin}{2}}{255} * 0.5 + 0.5\right) * 100.$$

4. The backlight control unit of claim 1, wherein when the difference between the first data and the second data is in a range of 16-64 gradations, the backlight duty ratio is determined by a following formula, $$\text{Backlight duty}(\%) = \left(\frac{\frac{Gmax + Gmin}{2}}{255} * 0.4 + 0.5\right) * 100.$$

5. The backlight control unit of claim 1, wherein when the difference between the first data and the second data is in a range of 64~128 gradations, the backlight duty ratio is determined by a following formula, $$\text{Backlight duty}(\%) = \left(\frac{\frac{Gmax + Gmin}{2}}{255} * 0.3 + 0.5\right) * 100.$$

6. The backlight control unit of claim 1, wherein when the difference between the first data and the second data is in a range of 128~191 gradations, the backlight duty ratio is determined by a following formula, $$\text{Backlight duty}(\%) = \left(\frac{\frac{Gmax + Gmin}{2}}{255} * 0.4 + 0.5\right) * 100.$$

7. The backlight control unit of claim 1, wherein when the difference between the first data and the second data is more than 191 gradations, the backlight duty ratio is determined by a following formula, $$\text{Backlight duty}(\%) = \left(\frac{\frac{Gmax + Gmin}{2}}{255} * 0.5 + 0.5\right) * 100.$$

8. A liquid crystal display (LCD) device, comprising:

a liquid crystal panel; and a backlight control unit for controlling a light output amount transmitted to the liquid crystal panel, in which the backlight control unit includes:

a gate driving unit and a data driving unit for driving the liquid crystal panel;

a timing controller for outputting signals to control the gate driving unit and the data driving unit, the timing controller including, an image data analyzer for calculating each representative gradation value by analyzing red, green, and blue gradations of the image data of one frame unit, and outputting two representative gradation values among three representative gradation values as maximum gradation value and minimum gradation value; and a dimming signal outputting unit for outputting a dimming control signal to control the light output amount of the backlight according to the maximum gradation value and minimum gradation value provided from the image data analyze; and an inverter for controlling the backlight to output a corresponding light output amount from the backlight according to the dimming control signal outputted from the timing controller, wherein the backlight duty ratio is determined by a difference between the maximum gradation value and the minimum gradation value.

9. The LCD device of claim 8, wherein the representative gradation values are average gradation values of the red, green, and blue gradations.

10. The LCD device of claim 8, wherein when the difference between the first data and the second data is less than 15 gradations, the backlight duty ratio is determined by a following formula, $$\text{Backlight duty}(\%) = \left(\frac{\frac{Gmax + Gmin}{2}}{255} * 0.5 + 0.5\right) * 100.$$

11. The LCD device of claim 8, wherein when the difference between the first data and the second data is in a range of 16~64 gradations, the backlight duty ratio is determined by a following formula, $$\text{Backlight duty}(\%) = \left(\frac{\frac{Gmax + Gmin}{2}}{255} * 0.4 + 0.5\right) * 100.$$

12. The LCD device of claim 8, wherein when the difference between the first data and the second data is in a range of 64~128 gradations, the backlight duty ratio is determined by a following formula, $$\text{Backlight duty}(\%) = \left(\frac{\frac{Gmax + Gmin}{2}}{255} * 0.3 + 0.5\right) * 100.$$

13. The LCD device of claim 8, wherein when the difference between the first data and the second data is in a range of 128~191 gradations, the backlight duty ratio is determined by a following formula, $$\text{Backlight duty}(\%) = \left(\frac{\frac{Gmax + Gmin}{2}}{255} * 0.4 + 0.5\right) * 100.$$

14. The LCD device of claim 8, wherein when the difference between the first data and the second data is more than 191 gradations, the backlight duty ratio is determined by a following formula, $$\text{Backlight duty}(\%) = \left(\frac{\frac{Gmax + Gmin}{2}}{255} * 0.5 + 0.5\right) * 100.$$

* * * * *